US005861567A

United States Patent [19]

Hirano

[11] Patent Number: 5,861,567

[45] Date of Patent: Jan. 19, 1999

[54] MUSIC COMPUTER SAVING ABNORMAL TONE GENERATION BY HANGUP

[75] Inventor: Masashi Hirano, Hamamatsu, Japan

[73] Assignee: Yamaha Corporation, Hamamatsu, Japan

[21] Appl. No.: 807,424

[22] Filed: Feb. 28, 1997

[30] Foreign Application Priority Data

Mar. 5, 1996 [JP] Japan ..... 8-073042

[51] Int. Cl.[6] ..... G10H 1/18; G10H 1/22

[52] U.S. Cl. ..... 84/609; 84/615; 84/618; 84/653; 84/656

[58] Field of Search ..... 84/609, 615, 616, 84/618–620, 653–654, 656–657

[56] References Cited

U.S. PATENT DOCUMENTS 5,600,521 2/1997 Kondo ..... 361/18

FOREIGN PATENT DOCUMENTS 58-179894 10/1983 Japan .

*Primary Examiner*—William M. Shoop, Jr.
*Assistant Examiner*—Marlon T. Fletcher
*Attorney, Agent, or Firm*—Graham & James LLP

[57] ABSTRACT

In a musical tone synthesis apparatus, a sequencer provides a sequence of event data effective to command generation of musical tones. A generator operates according to the event data to generate the musical tones. A detector detects when either of the sequencer and the generator suffers from misoperation which would cause abnormal generation of the musical tone. A blocking device operates when the misoperation is detected for blocking the generator to prevent the abnormal generation of the musical tone.

7 Claims, 7 Drawing Sheets

MUSIC COMPUTER SAVING ABNORMAL TONE GENERATION BY HANGUP

BACKGROUND OF THE INVENTION

The present invention relates to a musical tone synthesis apparatus having a processor to synthesize a musical tone.

The conventional musical tone synthesis apparatus is comprised of an input unit for inputting performance information, a tone generator unit for generating a waveform of a musical tone, and a central processing unit (CPU) for controlling the tone generator unit according to the inputted performance information. The CPU operates according to the inputted performance information to execute performance process such as channel assignment and parameter conversion for driving the tone generator unit. The CPU feeds parameters and note-on commands to assigned channels. The tone generator unit is composed of an internal tone generator for generating a wave-form of a musical tone based on the fed parameters, or an external tone generator receptive of MIDI data. In another case, the musical tone synthesis apparatus is comprised of a general purpose computer such as a personal computer which utilizes a software module of a tone generator to synthesize a waveform of a musical tone by processing input performance information such as MIDI event data. The program is installed in the computer to carry out the tone generation processing without use of a hardware module specialized for the tone synthesis. The computer can generate the musical tones by means of the software module or program, the CPU for running the program, and a D/A converter chip for converting the synthesized waveform into a corresponding audio signal.

The conventional musical tone synthesis apparatus composed of the personal computer executes application programs such as a tone synthesis program for synthesizing waveforms and a sequencer program for automatic play of music. However, the computer may incidentally suffers from stop or hangup of the application program so that the program no longer be executed. If the program is hung up in the middle of outputting a note-on or key-on command, a corresponding musical tone may be sustained to sound abnormally. Further, when the application program is accidentally stopped or hung up, supply of waveform data of a musical tone to the D/A converter may be turned off by interruption. Consequently, the D/A converter outputs a direct current which might cause a subsequent sound system to generate click noise. Even worse, leakage of the direct current might damage a loudspeaker contained in the sound system.

SUMMARY OF THE INVENTION

An object of the invention is to provide a musical tone synthesis apparatus which can avoid uncontrolled sounding of a musical tone, leakage of a direct current to a sound system, and generation of click noises if an application program is accidentally stopped or hung up.

The inventive musical tone synthesis apparatus comprises a sequencer that provides a sequence of event data effective to command generation of musical tones, a generator that is connected to the sequencer and generates the musical tones according to the event data, a detector that is connected to the sequencer and the generator, and detects when either of the sequencer and the generator suffers from misoperation which would cause abnormal generation of the musical tone, and a blocking device that is connected to the detector and blocks the generator to prevent the abnormal generation of the musical tone when the misoperation is detected.

In a form, the generator comprises a software module which operates by running a program and which suffers from the misoperation when the program is hung up.

In another form, the sequencer comprises a software module which operates by running a program and which suffers from the misoperation when the program is hung up.

In a specific form, the detector comprises a timer resettable everytime both of the sequencer and the generator institute periodical operation. A timeup occurs in the timer to detect the misoperation when either of the sequencer and the generator fails to institute the periodical operation.

In a practical form, the generator comprises a tone generating circuit which operates according to the event data to generate waveform data, and a converting circuit which converts the waveform data into the musical tone. The blocking device comprises a switch which disconnects the converting circuit from the generating circuit when the misoperation is detected.

According to the invention, the running state of the program is monitored. When misoperation is detected, the system institutes care treatment such as stopping of the tone generation and resetting of data input/output of the digital-to-analog converting circuit, thereby avoiding continued generation of abnormal tones, leakage of a direct current to a loudspeaker, and generation of click noises.

DETAILED DESCRIPTION OF THE INVENTION

Figure 1:
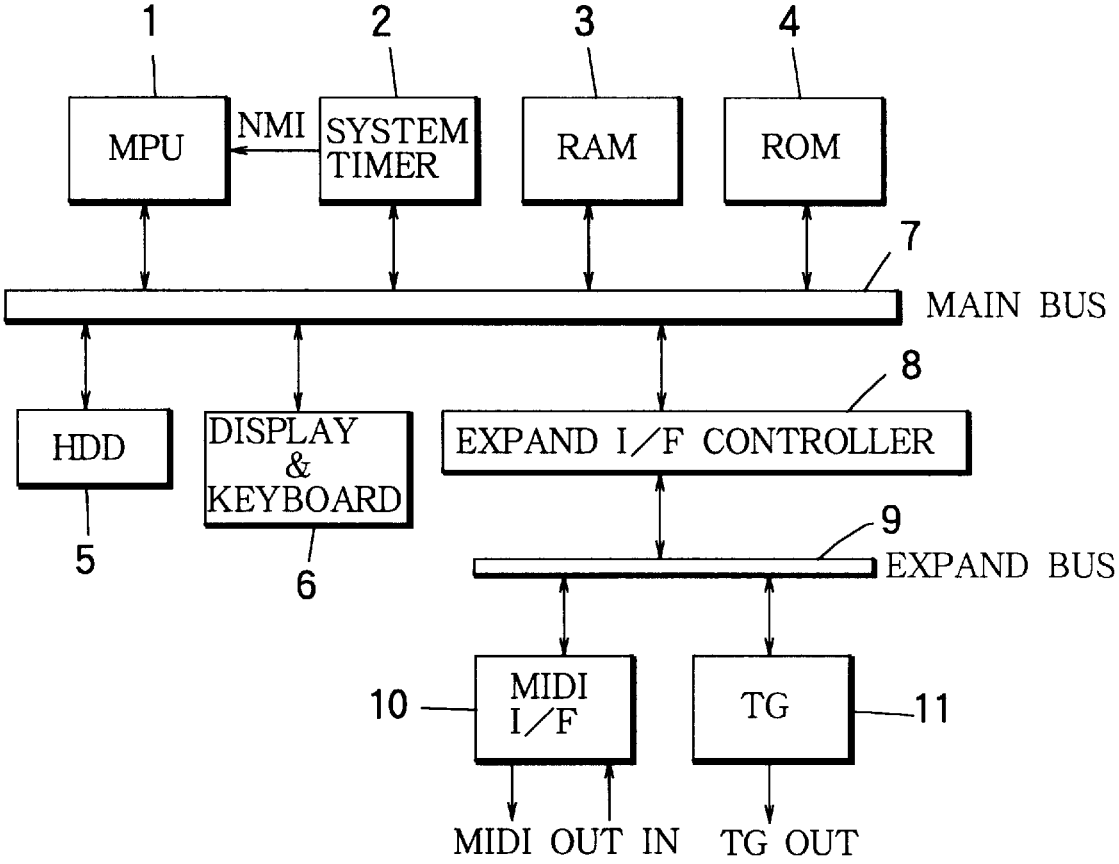
FIG. 1 is a block diagram showing overall construction of an embodiment of a musical tone synthesis apparatus according to the invention.

FIG. 1 is a block diagram showing an embodiment of the inventive musical tone synthesis apparatus comprised of a general-purpose computer. In the figure, the inventive apparatus includes a microprocessor unit (MPU) 1 and a system timer 2. The MPU 1 carries out various processes such as conversion of MIDI events provided for automatic play into control parameters which should be fed to a tone generator. Further, the MPU 1 executes application programs such as to synthesize sample of waveforms to generate musical tones. The system timer 2 operates under management by an operating system of the computer when misoperation occurs in the computer for applying a Non-Maskable Interrupt (NMI) to the MPU 1.

The inventive apparatus further includes a random access memory (RAM) 3, a read-only memory (ROM) 4, a hard disk drive (HDD) 5, and a display & keyboard 6. The RAM 3 has a memory area for memorizing the operating system (OS) and another area for memorizing application programs such as an automatic play program and a tone generation program which is a software module of a tone generator. The ROM 4 memorizes a setup program for initializing the MPU 1. The HDD 5 is provided for installing the application programs including the tone generation program and the automatic play program and for provisionally storing waveform data to synthesize various musical tones. The keyboard is an alphanumeric type used as an input device for the personal computer. The display is used for providing a graphic user interface.

The inventive apparatus further includes a main bus 7, an expand I/F controller 8, an expand bus 9, a MIDI interface 10 and an extension tone generator 11. The main bus 7 is provided for transferring data and addresses in the inventive apparatus. The expand I/F controller 8 controls data transaction between the main bus 7 and the expand bus 9. The expand bus 9 is provided for connection with peripheral devices such as extension boards. The MIDI interface 10 is an expanded interface provided for receiving externally inputted MIDI events and transmitting internally created MIDI events. The tone generator (TG) 11 receives the control parameters created by the MPU 1 to synthesize the waveforms of musical tones. Further, the tone generator 11 can admit sample data of waveforms computed by the MPU 1.

Figure 3:
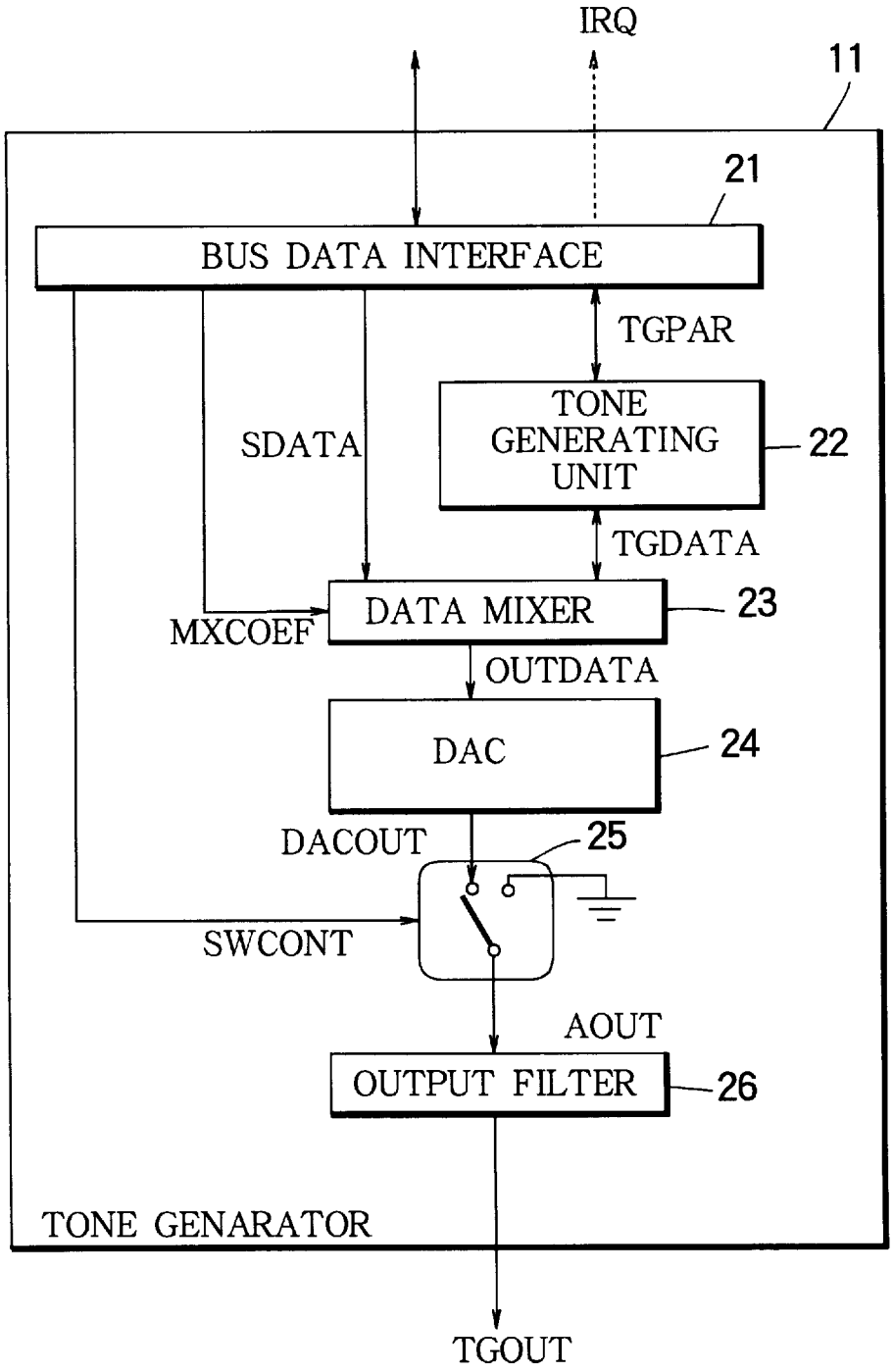
FIG. 3 is a block diagram showing structure of a tone generator equipped in the inventive musical tone synthesis apparatus.

FIG. 3 is a block diagram showing construction of the tone generator 11 which is formed on the extension board. The tone generator 11 is comprised of a bus data interface 21, a tone generating unit 22, a data mixer 23, a digital-to-analog converter (DAC) 24, a switch 25 and an output filter 26. The bus data interface 21 admits the control parameters TGPAR from the expand bus 9 and passes the control parameters TGPAR to the tone generating unit 22. The bus data interface 21 passes the waveform sample data SDATA and mixing coefficients MXCOEF from the expand bus 9 to the data mixer 23. Moreover, the bus data interface 21 passes a switch control signal SWCONT from the expand bus 9 to the switch 25. The tone generating unit 22 is composed of a hardware module of an LSI chip mounted on the extension board for synthesizes sample data TGDATA of waveforms of a musical tone according to the control parameters provided from the MPU 1. Alternatively, the tone generating unit 22 is provided in the form of a daughter board.

The data mixer 23 receives either of the waveform sample data TGDATA synthesized by the hardware tone generating unit 22 and the other waveform sample data SDATA synthesized by the software tone generating module which is operated by the MPU 1 to execute the waveform synthesis application program. The data mixer 23 mixes the two waveform sample data TGDATA and SDATA with each other according to the mixing coefficient MXCOEF to output composite sample data OUTDATA. The DAC 24 converts the composite sample data of the waveforms OUTDATA into corresponding analog waveform signals. The switch 25 selects either of the output from the DAC 24 and an earth level according to the switch control signal SWCONT. The output filter 26 removes unnecessary frequency band components from an analog signal AOUT provided from the switch 25.

Figure 2:
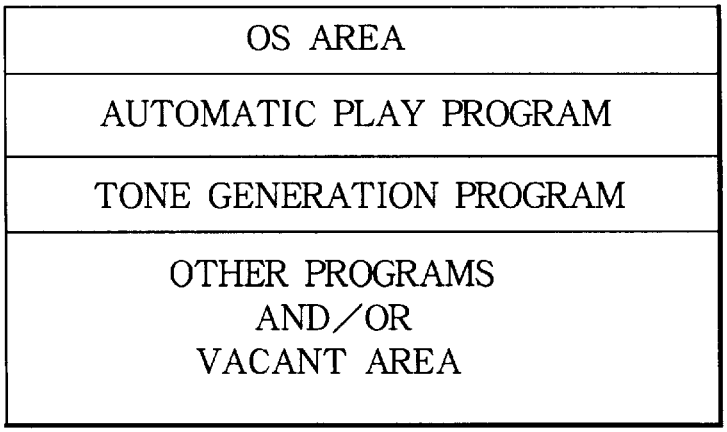
FIG. 2 is a memory map of RAM provided in the inventive musical tone synthesis apparatus.

FIG. 2 shows a memory map of the RAM 3. The RAM 3 is formed with an OS area for loading the OS, an application area for loading the automatic play program, another application area for loading the tone generation program and a vacant area which may be used for loading other application programs. When the inventive musical tone synthesis apparatus is turned on, the system is initialized by the initialization program memorized in the ROM 4. Then, under the control by the operating system loaded into the RAM 3, a desired application program is retrieved from the HDD 5 and loaded into the RAM 3 for execution in response to the user's operation.

For example, the user may select a karaoke application program of karaoke music which is executed to sound a karaoke accompaniment of a desired song from a loudspeaker and to display lyric words of the song with color wiping in synchronization with progression of the song so that the user can sing the song in parallel to the karaoke accompaniment under prompting by the displayed lyric words. Therefore, the karaoke application program contains at least an automatic play program for sequentially producing performance event data representative of the karaoke accompaniment of the song, and a tone generating program executed to synthesize waveforms of musical tones according to the event data.

Referring back to FIG. 1, as described before, the inventive apparatus is installed with the external tone generator 11 mounted on the extension board. In such a case, the MPU 1 may feed the performance event data to the tone generator 11 to use the same for synthesis of the waveforms of the musical tones. The user can select either of the external tone generator 11 composed of the hardware module mounted on the extension board and the internal tone generator composed of the software module which operates by running the tone generation program. Further, the user may uses both of the hardware and software tone generators to create variety of musical tones. This selection is achieved by controlling the mixing coefficient MXCOEF fed to the data mixer 23. For example, the mixing coefficient MXCOEF may be set to "0" so that the data mixer 23 outputs only the sample data SDATA formed by the software tone generator. If the mixing coefficient MXCOEF is set to "1", the data mixer 23 outputs only the sample data TGDATA formed by the hardware tone generator. If the mixing coefficient MXCOEF is set between "0" and "1", the data mixer 23 outputs mixture of the waveform sample data SDATA and TGDATA. In such a case, adjustment means may be required for adjusting a time lag between the sample data SDATA and TGDATA since the software tone generator consumes much more time for computation of the musical tone waveforms than the hardware tone generator.

By such a manner, the automatic play of the karaoke music is effected according to the user's settings to sound musical tones from the sound system (not shown in the figure). However, the application program may be incidentally hung up during the course of the automatic play. If the automatic play program is hung up in the middle of issuing a note-on or key-on event, a corresponding musical tone may abnormally continue to sound. If the program is hung up while the inputted data is held in the DAC 24, the inputted data does not change so that the DAC 24 contimnes to feed a direct current corresponding to the inputted data. The direct current may cause click noises in the sound system, or even worse the direct current leaks to damage a loudspeaker in the sound system.

In view of this, according to the invention, the musical tone synthesis apparatus detects when the program is hung up so as to shift the switch 25 within the tone generator 11 to the earth or ground level from the DAC 24. Consequently, the DAC 24 is disconnected from the output terminal of the tone generator 11. The tone generator 11 outputs the earth level which can block abnormal tone generation, click noises and other accidents. The switch 25 is controlled in response to the control signal SWCONT which is fed to the tone generator 11 from the MPU 1 when the running program incidentally misoperates or hangs up. In detail, the system timer 2 operates as a detector device upon timeup when the running program hangs up to issue NMI to MPU 1. The system timer 2 is normally provided for monitoring or managing process of the OS and application programs. The system timer 2 is resettable everytime the process returns to the OS to restart counting of a preset time. The preset time never lapses as long as the MPU 1 regularly and correctly institutes periodical operation in which the process returns to the OS within the preset time. If the process fails to return to the OS due to misoperation or hangup, the system timer 2 counts up the preset time to thereby issue NMI.

Figure 4:
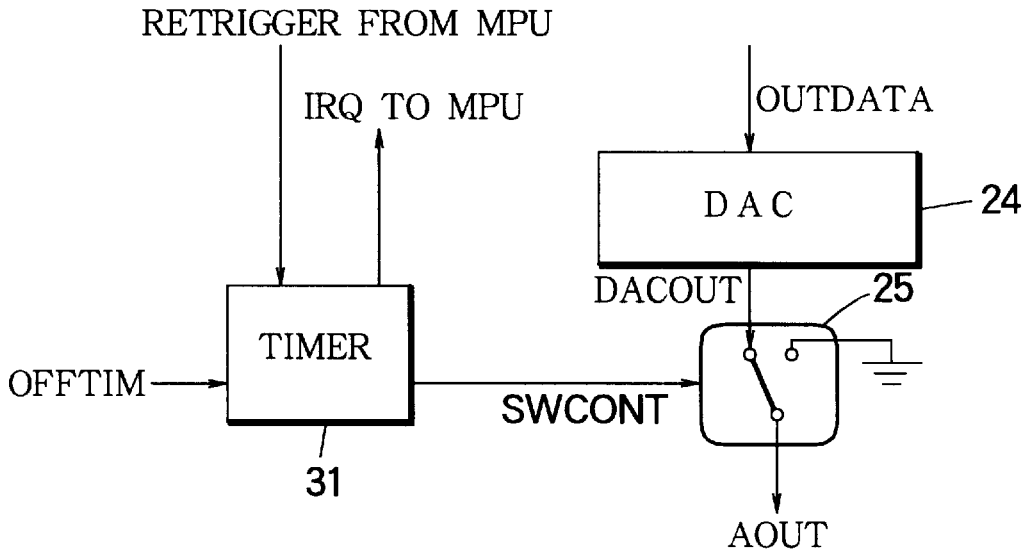
FIG. 4 is a block diagram showing an outline of another embodiment of the inventive musical tone synthesis apparatus.

FIG. 4 shows a modification of the inventive apparatus. A retriggerable timer 31 is provided as a detector device within the tone generator 11. The timer 31 detects when the currently running program hangs up to change the switch 25 from the DAC 24 to the ground so as to block the output of the DAC 24 while the tone generator 11 outpputs the ground level.

Figure 5A:
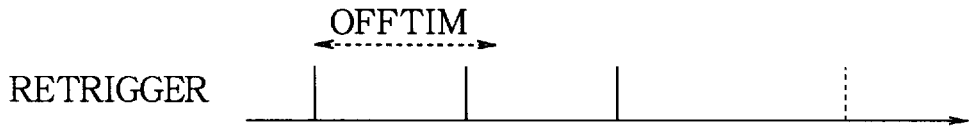
FIGS. 5(*a*), 5(*b*) and 5(*c*) are a timing chart showing operation of the FIG. 4 embodiment.
Figure 5B:
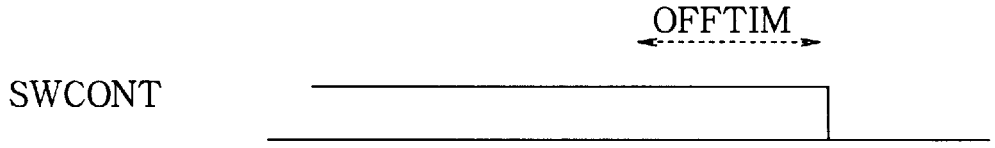
Figure 5C:
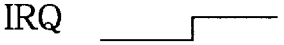

FIGS. 5(*a*)–5(*c*) are a timing chart showing operation of the FIG. 4 construction. The retriggerable timer 31 is set with an off time OFFTIM. The MPU 1 periodically feeds a retrigger signal to the timer 31 within the off time OFFTIM as long as the MPU 1 operates normally. Therefore, as indicated by the left portion of FIG. 5(*a*), the timer 31 is periodically retriggered during the course of the regular, correct and periodic operation in the system so that the timer 31 never causes timeup or timeout. In this state, the timer 31 outputs a control signal SWCONT of high level effective to place the switch 25 to connect between the DAC 24 and the output AOUT of the tone generator.

When the program hangs up due to misoperation, the MPU 1 no longer issues the retrigger signal to the timer 31 as indicated in the right portion of FIG. 5(*a*). Thus, the timer 31 counts out when the off time OFFTIM lapses after the last retrigger signal. Upon the timeup of the timer 31, the control signal SWCONT outputted from the timer 31 changes from the high level to the low level as indicated by FIG. 5(*b*). Consequently, the switch 25 is switched to the earth level to block the output of the DAC 24. In this embodiment, the retrigger signal is periodically issued while the MPU 1 executes the application program. Alternatively, the tone generator 11 may detect periodic access from the MPU 1 for data transfer or else so as to internally generate a retrigger signal within the tone generator 11. Further, as shown in FIG. 5(*c*), upon the timeup, the timer 31 issues an interrupt request IRQ to the MPU 1 to notify thereto occurrence of abnormality in the system.

Figure 6:
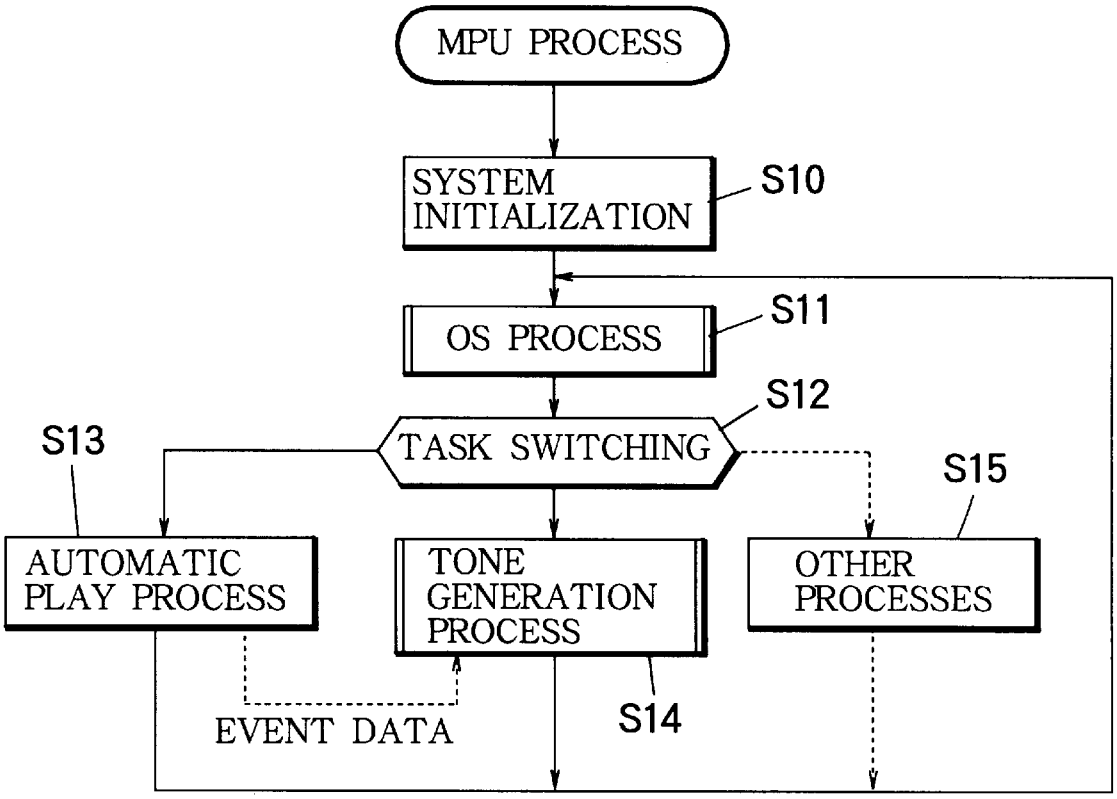
FIG. 6 is a flowchart showing a main routine executed by an MPU involved in the inventive musical tone synthesis apparatus.

Next, description is given for operation of the inventive musical tone synthesis apparatus with reference to flowcharts. FIG. 6 is a flowchart showing a main routine executed by the MPU 1. The MPU process starts upon power on of the apparatus. First, the initialization program memorized in the ROM 4 is executed at step S10 so that the OS is loaded from the HDD 5 into the RAM 3. Thereafter, the system management is handed to the OS. Under the control by the OS, desired application programs is retrieved from the HDD 5 and loaded into the RAM 3. For example, the application programs may include an automatic play program and a tone generation program, those of which are executed in response to the user's command.

A subsequent OS process at step S11 includes a restart or retrigger process of the system timer 2 and a system management process such as job scheduling. The OS works on a multitask basis such that a plurality of tasks or applications can be executed in parallel under switching by the OS. Namely, one of the tasks is selected for execution by the task switching at step S12. The tasks may be dynamically selected and switched according to their priorities and the current processing states.

An automatic play process may be executed at step S13 as a consequence of the task switching by step S12. In this process, the automatic play program is executed to create note event data in synchronization of music progression according to designated performance data. Otherwise, a tone generation process may be executed at step S14 as a consequence of the task switching by step S12. In this process, a corresponding musical tone is generated in response to the created event data. Occasionally, other programs may be executed at step S15 after the task switching by step S12. Then, the main routine returns to the OS process of step S11 after any one of steps S13, S14 and S15 is finished so as to again carry out the restart process of the system timer 2 and the system management process. By such a manner, the main routine is cyclicly executed. As long as the main routine is executed normally, the system timer 2 is periodically restarted or retriggered within each period of the preset time by the OS process at step S11. Namely, the MPU 1 is never interrupted by the NMI.

In the musical tone generating process of step S14, sample data of the musical tone waveforms is synthesized by various ways. First, the software tone generator module may be operated by executing the tone generation program to synthesize the waveform sample data. Second, the hardware tone generator device composed of an LSI chip or DSP may be operated to synthesize the waveform sample data. Third, an external tone generator is operated to synthesize the waveform sample data by feeding MIDI event data to the external tone generator and by controlling the same. In practice, the tone generation process selectively utilizes the first, second and third ways singularly or in combination. In selection of the first, second and third tone generators, the OS or associated program may automatically check the system configuration to recognize available ones of the tone generators so as to assign the created performance event to the available tone generators. Alternatively, the user may manually select and set desired ones of the various tone generators to be used for the tone generation. Actually, the selection or combination of the first, second and third ways of the tone generation is effected by changing the mixing coefficient MXCOEF to control the data mixer 23.

Figure 7:
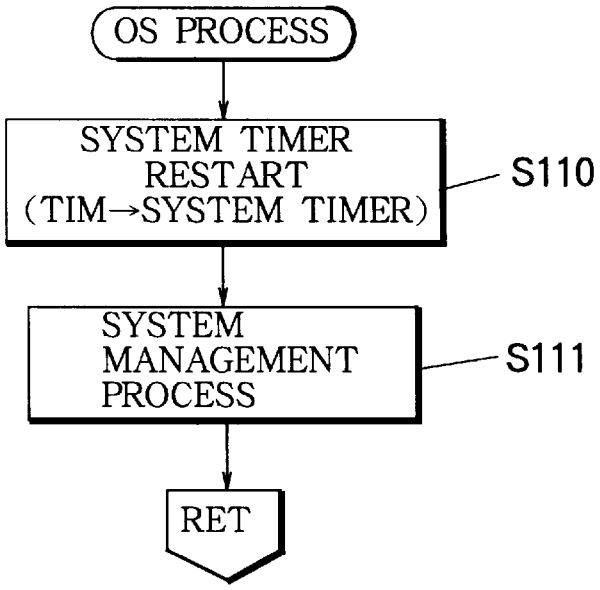
FIG. 7 is a flowchart showing OS process in the main routine.

Next, detailed description is given for the OS process executed at step S11 of the main routine in conjunction with a flowchart of FIG. 7. In the OS process, the system timer 2 is restarted at step S110 by setting a predetermined time interval TIM into the system timer 2. As described before, the system timer 2 is provided to monitor and manage the processing states of the OS and the applications. The time interval TIM is predetermined such that the routine returns to the OS process within TIM as long as the MPU 1 normally and periodically conducts the processes. Namely, as described in conjunction with FIG. 6, the system timer 2 is reset or restarted everytime the processes returns to the OS so that the system timer 2 never yields timeup as far as the MPU 1 normally carries out the processes. However, when the MPU 1 accidentally runs away during the course of the operation of the OS or the application so that the processes fail to return to the OS, the system timer 2 does not restart and yields the timeup when the timer interval TIM is counted out after the last restart of the system timer 2. Upon the timeup of the system timer 2, the exclusive and compulsive NMI is issued to the MPU 1 so that the MPU 1 outputs to the tone generator 11 the control signal SWCONT effective to shift the switch 25 from the DAC 24 to the earth. After the system timer restart process is finished at step S110, the system management process such as the job scheduling is carried out at step S111, thereby returning.

Figure 8:
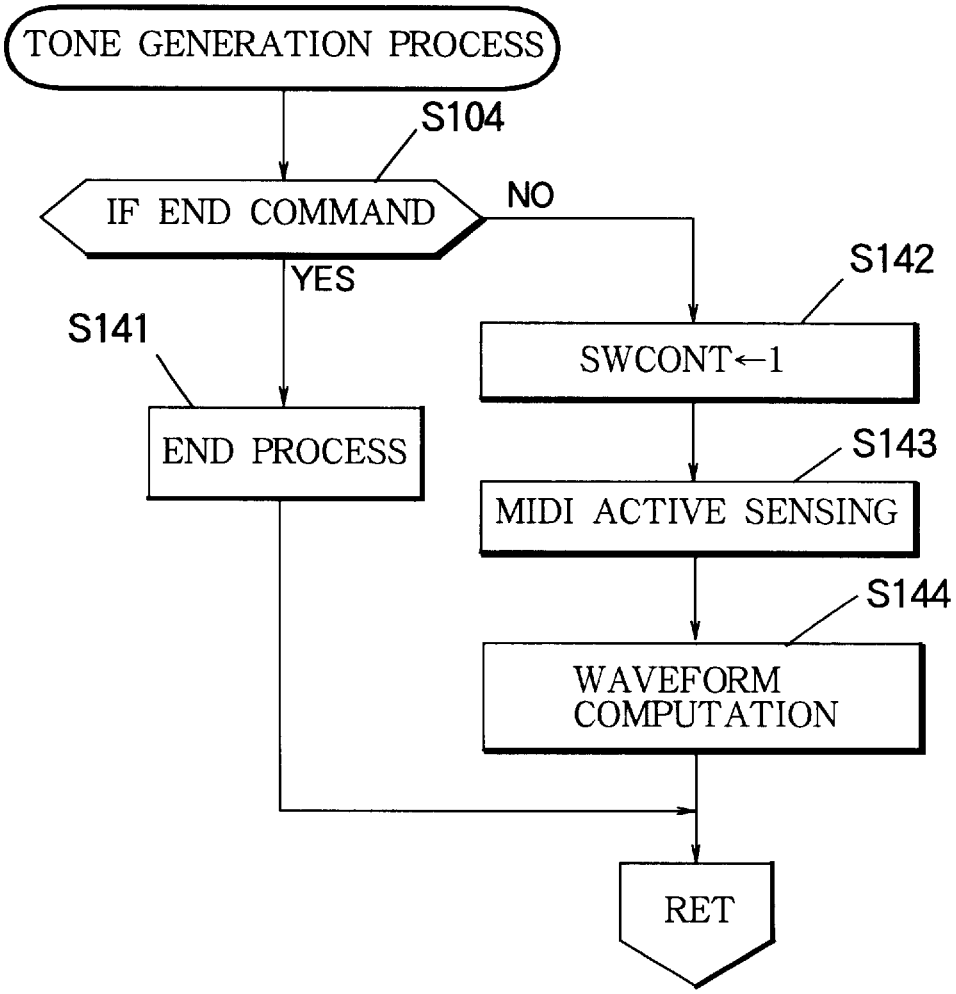
FIG. 8 is a flowchart showing tone generation process in the main routine.

Next, detailed description is given for the tone generation process executed at step S14 of the main routine with reference to a flowchart of FIG. 8. In this tone generation process, check is made at step S140 as to if an end command of the tone generation is issued. If YES, the end process is carried out at step S141 such as to stop tone generation of a currently active channel of the tone generator. If the check result of step S140 is NO, the routine branches to step S142 where the switch control signal SWCONT is set to "1". Consequently, the switch 25 is connected to the DAC 24 to allow the same to output a sound signal.

Then, MIDI active sensing process is carried out at step S143. The MIDI active sensing process is performed to check MIDI connection between transmitting and receiving devices. In detail, the transmitting device of a MIDI signal transmits an active sensing signal within 300 ms at most. If the receiving device fails to admit the active sensing signal within a predetermined time interval, an emergency process such as stopping of the tone generation is invoked. In this embodiment, the MIDI active sensing signal is issued under timer control. The active sensing signal is defined by $FE_H$ in hexadecimal notation according to the MIDI standard.

After the MIDI active sensing process, a computation process is carried out at step S144 to generate a waveform of a musical tone. In this embodiment, the tone generation program is executed to mainly operate the software tone generator to synthesize the waveform by computation. The thus obtained sample data SDATA of the musical tone waveform is sequentially fed to the data mixer 23 of the hardware tone generator 11. In modification of the system, the tone generation program simply writes the computed sample data of the musical tone waveform into a waveform data buffer on the RAM 3. A separate device driver (software) prepared for the tone generator 11 is used to transfer the sample data from the buffer to the tone generator 11. After the waveform computation process of step S144 is finished, the routine returns.

Figure 9:
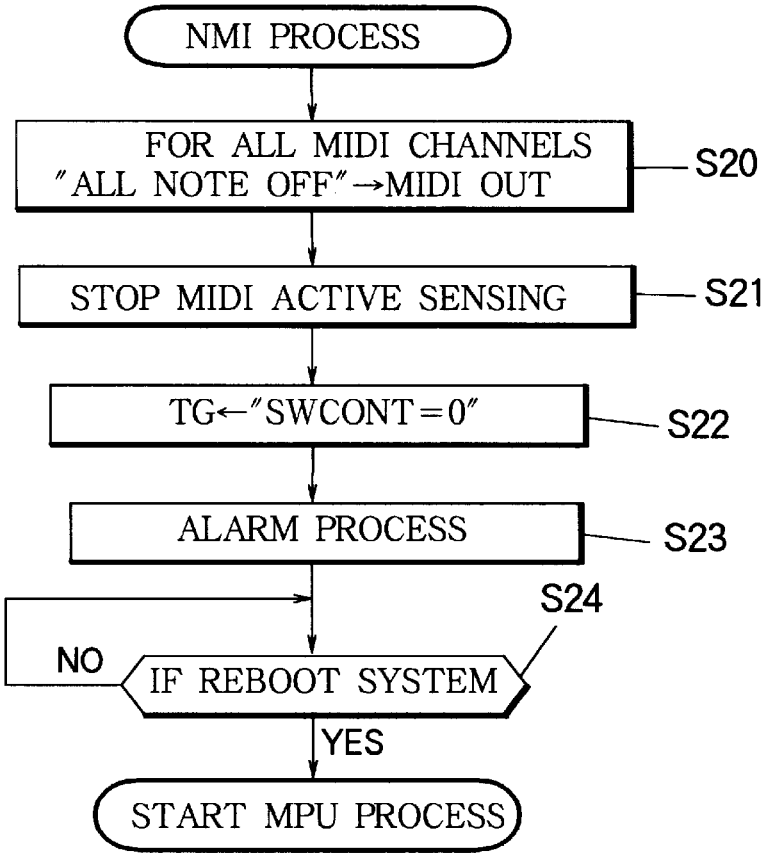
FIG. 9 is a flowchart showing NMI process executed in the inventive musical tone synthesis apparatus.

Next, description is given for NMI process which is invoked upon timeup of the system timer 2 in conjunction with a flowchart of FIG. 9. In the NMI process, an "all note off" signal is issued to all of MIDI channels 1–16 of the tone generator at step S20. The "all note off" signal is given by BX $7B_H$ according to the MIDI standard. Then, the output of the MIDI active sensing is stopped at step S21. Further, a "reset" signal given by $FF_H$ which is one of MIDI realtime messages may be issued. It should be noted that the "reset" signal is differently treated by receiving devices according to their types. Therefore, it is preferable to preset issue or non-issue of the "reset" signal. Further, it is preferable to select various recovery processes upon the "reset" signal.

Then, an output blocking command is issued to the mounted tone generator 11 at step S22. Actually, the switch control signal SWCONT of "0" level is fed to the tone generator 11. Then, abnormality alarm process is invoked at step S23 such that a tone generation stop command is issued to the tone synthesis devices such as the tone generating unit 22. Actually, this stop command is effected by volume control, key off or reset. Then, check is made at step S24 as to if rebooting of the system is commanded by the user. If YES, MPU start process is conducted to reboot the system. If NO, the routine remains in step S24 to wait for the reboot command.

Figure 10:
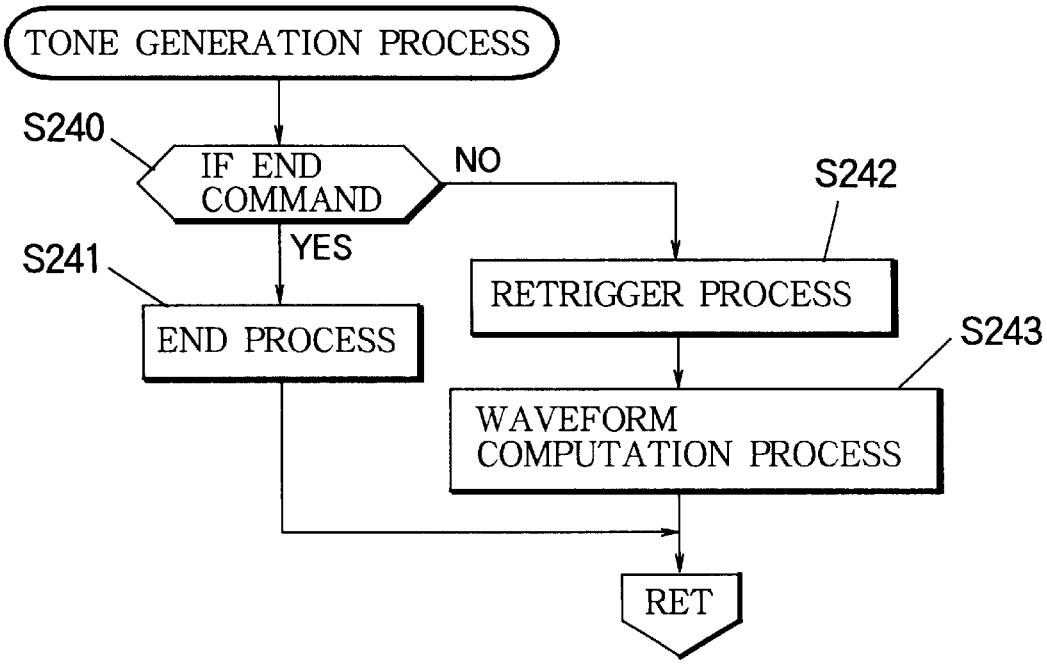
FIG. 10 is a flowchart showing another tone generation process involved in the main routine.

Lastly, referring to a flowchart of FIG. 10, description is given for a tone generation process performed in the embodiment shown in FIGS. 4 and 5 in which the switch 25 within the tone generator 11 is shifted from the DAC 24 to the earth terminal upon the hangup of the program. First, check is made at step S240 as to if an end command is inputted to terminate the tone generation. If YES, the end process is carried out at step S241 to terminate the tone generating operation of the active channels.

If the check result of step S240 is NO, the routine branches to step S242 where a retrigger process is carried out by actually generating a retrigger signal or by commanding generation of the retrigger signal. This retrigger process is executed everytime the tone generation program is called to perform the task to periodically output the retrigger signal. Consequently, the switch control signal SWCONT maintains the logic level "1" so that the switch 25 is controlled to pass the output DACOUT of the DAC 24 as illustrated at the left side of FIG. 5(*a*).

On the other hand, when the task is not switched to the tone generation program due to the run away of the MPU 1 for incidental reason, the issue of the retrigger signal stops as illustrated at the right side of FIG. 5(*a*). Consequently, the switch control signal SWCONT falls from the level "1" to the level "0" as illustrated by FIG. 5(*b*). Thus, the switch 25 blocks the output DACOUT from the DAC 24 and outputs the earth level. The retrigger signal may be directly written into the tone generator 11. Alternatively, the MPU 1 writes into an address area of the memory shared by the tone generator 11 such that the tone generator 11 treats the writing by the MPU 1 as the retrigger signal upon detection of the writing by the MPU 1. Otherwise, the automatic play program may feed a retrigger signal.

As shown in FIG. 5(*c*), occurrence of abnormality is notified to the MPU 1 by means of IRQ from the tone generator 11. Alternatively, the tone generator 11 may have a flag which is turned off upon the abnormality, while the MPU 1 monitors the flag to detect the abnormality. When the abnormality is detected, the MPU 1 commences necessary process equivalent to the NMI process.

After the retrigger process is finished, the routine proceeds to step S243 where the computation process is performed to form the waveform of the musical tone. In this embodiment, the tone generation program is executed to operate the software tone generator for computational synthesis of the musical tone waveform. The sample data of the musical tone waveform obtained by step S243 is sequentially transferred to the tone generator 11. In a modified form, the tone generation program may simply writes the computed sample data of the waveform into a buffer prepared on the RAM 3. A device driver (software) prepared for the tone generator 11 transfers the sample data from the buffer of the RAM 3 to the tone generator 11. Then, the routine returns after the computation process of step S243 finishes.

In this embodiment, a karaoke song voiced by the user is inputted through a microphone (not shown) into an analogto-digital converter (ADC, not shown) provided in the tone generator 11 so as to convert the singing voice into a corresponding digital signal. This digital signal is mixed with the sample data of the musical tone waveform by the data mixer 23. Consequently, the sound system concurrently reproduces the musical tones of the karaoke accompaniment and the singing voice of the karaoke song. This embodiment treats the karaoke application program as one example. Generally, the invention is applicable to the musical tone synthesis apparatus which treats either of the automatic play program (music sequence program) and the tone generation program.

As described above, according to the invention, when abnormality or misoperation is detected during the course of running musical programs, the system institutes care process such as stopping of the tone generation and the resetting of data input/output of the DAC, thereby avoiding contained generation of abnormal tones, leakage of a direct current to the sound system, and generation of click noise.

In the disclosed embodiments, the switch 25 is utilized to control the DAC 24 to switch between the blocked state and the work state. In modification, a VCA or an electronic volume may be used to control the DAC 24 in place of the switch 25. Normally, the DAC is supplied with a reference voltage, and divides or multiplies the reference voltage according to input digital data to produce an output analog voltage signal corresponding to the input digital data. In such a case, the reference voltage may be switched from a normal value to a zero level when the CPU runs out of order, thereby effectively blocking the output of the DAC 24.

Figure 11:
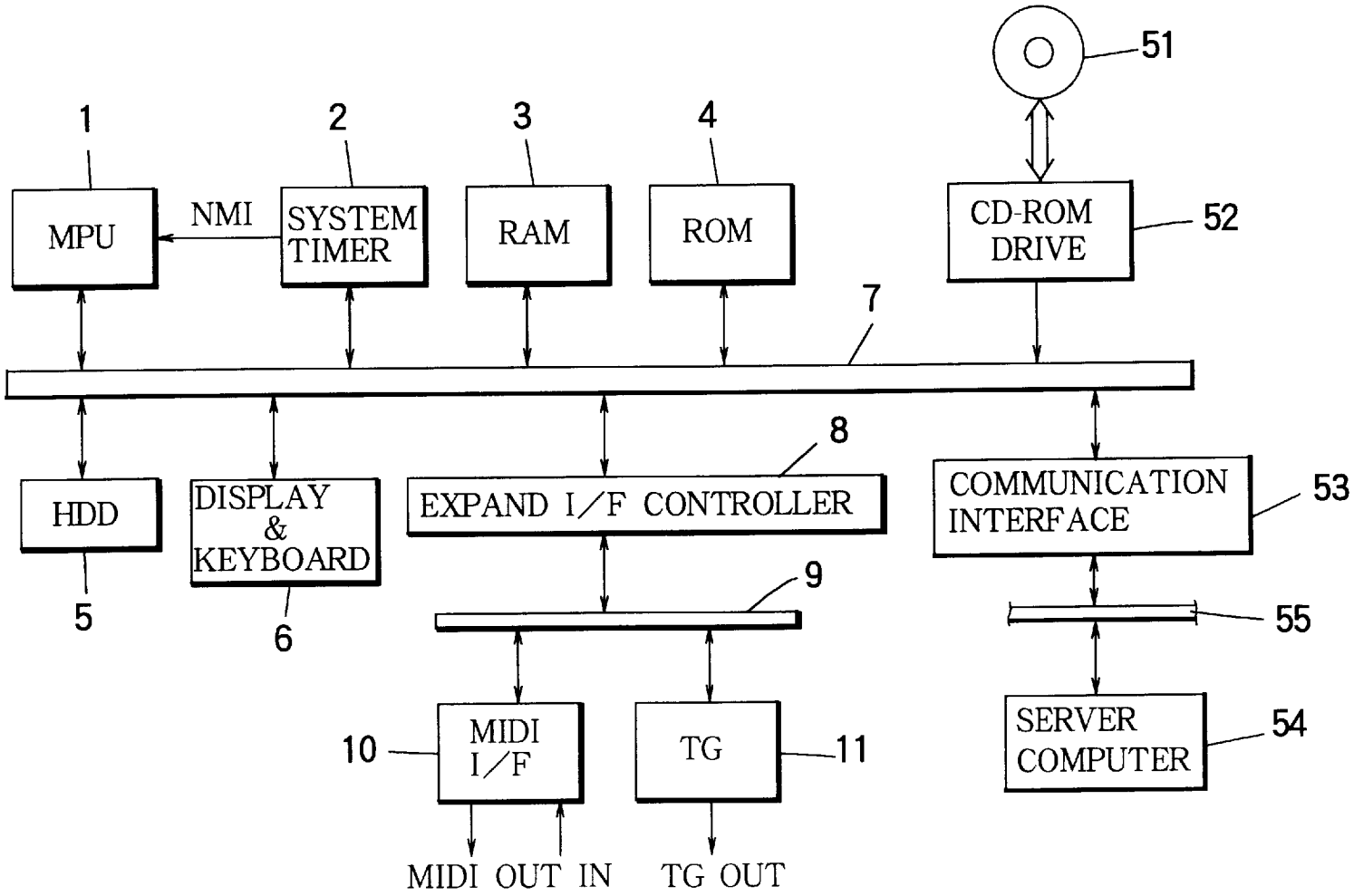
FIG. 11 is a block diagram showing an additional embodiment of the inventive musical tone synthesis apparatus.

FIG. 11 shows an additional embodiment of the inventive musical tone synthesis apparatus. This embodiment has basically the same construction as the first embodiment shown in FIG. 1. The same components are denoted by the same references as those of the first embodiment to facilitate better understanding of the additional embodiment. The storage such as HDD 5, ROM 4 and RAM 3 can store various data such as waveform data and various programs including the operation system program or basic program, the tone generation program and other application programs. Normrally, the HDD 5 or ROM 4 provisionally stores these programs. However, if not, any program may be loaded into the apparatus. The loaded program is transferred to the RAM 3 to enable the MPU 1 to operate the inventive system of the musical tone synthesis apparatus. By such a manner, new or version-up programs can be readily installed in the system. For this purpose, a machine-readable media such as a CD-ROM (Compact Disc Read Only Memory) 51 is utilized to install the program. The CD-ROM 51 is set into a CD-ROM drive 52 to read out and download the program from the CD-ROM 51 into the HDD 5 through the main bus 7. The machine-readable media may be composed of a magnetic disk or an optical disk other than the CD-ROM 51.

A communication interface 53 is connected to an external server computer 54 through a communication network 55 such as LAN (Local Area Network), public telephone network and INTERNET. If an internal storage does not reserve needed data or program, the communication interface 53 is activated to receive the data or program from the server computer 54. The MPU 1 transmits a request to the server computer 54 through the interface 53 and the network 55. In response to the request, the server computer 54 transmits the requested data or program to the apparatus. The transmitted data or program is stored in the internal storage to thereby complete downloading.

The inventive musical tone synthesis apparatus can be implemented by a personal computer which is installed with the needed data and programs. In such a case, the data and programs are provided to the user by means of the machine-readable media such as the CD-ROM 51 or a floppy disk. The machine-readable media contains instructions for causing the personal computer to perform the inventive musical tone synthesis method as described in conjunction with the previous embodiments. Namely, the machine-readable media contains instructions for causing the musical tone synthesis apparatus to perform a method comprising the steps of operating a sequencer device to provide a sequence of event data effective to command generation of musical tones, operating a generator device according to the event data to generate the musical tones, detecting when either of the sequencer device and the generator device suffers from misoperation which would cause abnormal generation of the musical tone, and blocking the generator device to prevent the abnormal generation of the musical tone when the misoperation is detected.

What is claimed is:

1. A musical tone synthesis apparatus having a processor, said apparatus comprising:

a sequencer that provides a sequence of event data effective to command generation of a musical tone signal, said sequencer comprising a first software module including a first program executable by said processor;

a generator that is connected to the sequencer and generates the musical tone signal according to the event data, said generator comprising a second software module including a second program executable by said processor, said second program entering a misoperation condition when said program is unintentionally hung up;

a detector that is connected to the generator, and that detects said misoperation condition which would cause abnormal generation of the musical tone signal; and a blocking device that is connected to the detector and blocks the generator to prevent the abnormal generation of the musical tone signal when the misoperation condition is detected.

2. A musical tone synthesis apparatus according to claim 1, wherein the detector comprises a timer resettable every time the generator institutes periodical operation, the timer counting out and detecting the misoperation condition when the generator fails to institute the periodical operation.

3. A musical tone synthesis apparatus according to claim 1, wherein the generator comprises a tone generating circuit which operates according to the event data to generate waveform data, and a converting circuit which converts the waveform data into the musical tone signal, and wherein the blocking device comprises a switch which disconnects the converting circuit from the tone generating circuit when the misoperation condition is detected.

4. A musical tone synthesis apparatus according to claim 1, further comprising a task switch for selectively switching programs to be run by the processor so that the detector does not operate when other programs besides the generator have been selected to run.

5. A musical tone synthesis apparatus comprising:

sequencer means operative to provide a sequence of event data effective to command generation of a musical tone signal;

generator means operative according to the event data to generate the musical tone signal;

detector means for detecting a misoperation condition of the generator means which would cause abnormal generation of the musical tone signal; and blocking means operative when the misoperation condition is detected for blocking the generator means to prevent the abnormal generation of the musical tone signal.

6. A musical tone synthesis method comprising the steps of:

operating a sequencer device to provide a sequence of event data effective to command generation of a musical tone signal;

operating a generator device according to the event data to generate the musical tone signal;

detecting when a misoperation condition of the generator device occurs which would cause abnormal generation of the musical tone signal; and blocking the generator device to prevent the abnormal generation of the musical tone signal when the misoperation condition is detected.

7. A machine readable media containing instructions for causing a musical tone synthesis apparatus to perform a method comprising the steps of:

operating a sequencer device to provide a sequence of event data effective to command generation of a musical tone signal;

operating a generator device according to the event data to generate the musical tone signal;

detecting when a misoperation condition occurs which would cause abnormal generation of the musical tone signal; and blocking the generator device to prevent the abnormal generation of the musical tone signal when the misoperation condition is detected.

* * * * *